US005209414A

United States Patent [19]

Clemens et al.

[11] Patent Number: 5,209,414

[45] Date of Patent: May 11, 1993

[54] APPARATUS FOR PRECISELY WINDING A COIL OF WIRE

[75] Inventors: Douglas J. Clemens, Garrett; John H. Wall, Columbia City, both of Ind.

[73] Assignee: Dana Corporation, Toledo, Ohio

[21] Appl. No.: 785,044

[22] Filed: Oct. 30, 1991

[51] Int. Cl.[5] ..... B65H 54/10; B65H 54/28

[52] U.S. Cl. ..... 242/25 R; 242/158 R

[58] Field of Search ..... 242/25 R, 158 R, 158.2, 242/158.4 R, 7.14, 7.15, 7.16

[56] References Cited

U.S. PATENT DOCUMENTS

| | | | |
|---|---|---|---|
| Re. 33,240 | 6/1990 | Lothamer . | |
| 247,082 | 9/1881 | Manly et al. . | |
| 728,183 | 5/1903 | Varley . | |
| 1,944,870 | 1/1934 | Apple . | |
| 2,930,014 | 3/1960 | Van Der Hoek et al. . | |
| 3,109,601 | 11/1963 | Van Der Hoek et al. . | |
| 3,159,907 | 12/1964 | Bloom . | |
| 3,242,381 | 3/1966 | Davis . | |
| 3,565,357 | 2/1971 | Noguchi et al. . | |
| 3,583,650 | 6/1971 | Zaborovsky . | |
| 3,989,200 | 11/1976 | Bachi . | |
| 4,022,391 | 5/1977 | Stein et al. | 242/25 R |
| 4,130,249 | 12/1978 | Steinhilber . | |
| 4,142,289 | 3/1979 | Roethke . | |
| 4,244,539 | 1/1981 | Taneda et al. | 242/158 R |
| 4,283,020 | 8/1981 | Bauer et al. . | |
| 4,410,147 | 10/1983 | Seibert . | |
| 4,424,939 | 1/1984 | Ohashi et al. . | |
| 4,428,540 | 1/1984 | Calcagno et al. . | |
| 4,480,799 | 11/1984 | Yano et al. . | |
| 4,485,978 | 12/1984 | O'Connor . | |
| 4,583,696 | 4/1986 | Mosher . | |
| 4,588,143 | 5/1986 | Hetzel . | |
| 4,668,544 | 5/1987 | Takahashi . | |
| 4,725,010 | 2/1988 | Lothamer . | |
| 4,725,017 | 2/1988 | Camardella . | |
| 4,746,075 | 5/1988 | Hoxit . | |
| 4,771,958 | 9/1988 | Hewitt . | |
| 4,834,308 | 5/1989 | Maccaferri . | |
| 4,838,500 | 6/1989 | Graham . | |
| 4,951,889 | 8/1990 | Camardella et al. . | |

*Primary Examiner*—Stanley N. Gilreath

*Attorney, Agent, or Firm*—MacMillan, Sobanski & Todd

[57] ABSTRACT

An apparatus for precisely winding a coil of wire, either free standing or on a bobbin, includes a servo motor for rotating a spool and a wire feeding mechanism for guiding the wire onto the rotating spool. The wire feeding mechanism is mounted on a ball screw shaft connected to a stepper motor. Thus, rotation of the ball screw shaft by the stepper motor causes axial movement of the wire feeding mechanism. A wire feed angle sensor is provided on the wire feeding mechanism for generating a signal which is representative of the load angle at which the wire is wound upon the spool. A control system, such as a microprocessor or a programmable controller, is responsive to the load angle signal for controlling the operation of the stepper motor and, thus, the position of the wire feeding mechanism relative to the point of winding on the spool. As a result, a constant load angle is maintained throughout the winding process. A wire diameter sensor also generates signals to the control system. The control system is responsive to the wire diameter signal for determining the number of windings which can be made on each layer of the spool. In an alternate embodiment, the control system determines the position of a movable flange in accordance with the diameter of the wire to provide a predetermined number of windings per layer.

11 Claims, 4 Drawing Sheets

APPARATUS FOR PRECISELY WINDING A COIL OF WIRE

BACKGROUND OF THE INVENTION

This invention relates in general to systems for winding filaments into coils and in particular to an apparatus for precisely winding a coil of wire. This invention is applicable both to free standing coils and to coils which are wound upon bobbins.

Machines for winding coils of filaments, such as wires, onto bobbins are well known in the art. A typical bobbin winding machine includes a spindle upon which the bobbin is mounted for rotation. An end of a wire or other filament is secured to the bobbin, then wound thereabout as the bobbin is rotated. The wire is preferably secured adjacent to one end of the bobbin, then moved axially as the bobbin is rotated. As a result, a first layer of the wire will be wound as a plurality of adjacent windings evenly throughout the length of the bobbin before a second, overlapping layer is wound in the opposite axial direction.

To insure that the adjacent windings of the wire are closely packed together, it is desirable that the axial position of the wire feeding mechanism lag slightly behind the axial position of the point at which the wire is wound on the bobbin. Such lagging causes the windings of wire to be preloaded against one another, preventing gaps from being formed between adjacent windings. The lagging position of the wire feeding mechanism relative to the point of winding on the bobbin causes the wire to be dispensed at an angle therebetween, commonly referred as a load angle. This winding process generally results in the most efficient use of the available space provided on the bobbin.

A common problem encountered in known coil winding machines is that of precise coordination between wire feeding mechanism and the point of winding on the bobbin so as to maintain the desired lagging relationship. In theory, the optimum speed at which the wire feeding mechanism should be axially advanced can be calculated from the nominal diameter of the wire being wound, the axial length of the bobbin, and the rotational speed of the bobbin. Thus, the wire feeding mechanism can be moved so as to always maintain the wire at the desired load angle as it is wound onto the bobbin.

In practice, however, it has been found that the diameter of the wire can vary significantly from the nominal diameter, such as when different batches of wire are being wound or even between the beginning and ending of winding of a single long filament of wire. While such diameter variations are generally relatively small, they can become significant as they accumulate while a coil is being wound. This is particularly true if the nominal diameter of the wire is relatively small to begin with. Since the wire feeding mechanism is being moved axially at a speed which is based upon the nominal diameter of the wire, the accumulated error resulting from diameter variations can cause the wire feeding mechanism to be incorrectly positioned relative to the point of winding. Thus, the desired load angle is lost, and gaps may be created in the adjacent windings of the wire as it is wound in successive layers upon the bobbin. Consequently, the wire is wound in an inefficient manner on the bobbin. This is commonly referred to as coil breakup.

Several solutions have been proposed to prevent coil breakups. Some coil winding machines are provided with grooved tooling which directs the wire onto the spool at precise intervals, regardless of the diameter thereof. Unfortunately, machines of this type are expensive. Also, it is not practical to provide grooved tooling for winding wire having a very small diameter. It is also known to provide servo motors or microstepper motors for precisely positioning the wire feeding mechanism during use. However, while such stepper motors improve the accuracy of the winding process, they cannot compensate for variations in the wire diameter, as described above. Accordingly, it would be desirable to provide a coil winding mechanism which is responsive to variations in wire diameter for preventing coil breakups during the winding process.

SUMMARY OF THE INVENTION

This invention relates to an improved apparatus for precisely winding a coil of wire, either free standing or on a bobbin. The apparatus includes a servo motor for rotating the bobbin. A wire feeding mechanism is provided for guiding the wire onto the rotating bobbin. The wire feeding mechanism is mounted on a ball screw shaft connected to a stepper motor. Thus, rotation of the ball screw shaft by the stepper motor causes axial movement of the wire feeding mechanism. A wire feed angle sensor is provided on the wire feeding mechanism for generating a signal which is representative of the load angle at which the wire is wound upon the bobbin. A control system, such as a microprocessor or a programmable controller, is responsive to the load angle signal for controlling the operation of the stepper motor and, thus, the position of the wire feeding mechanism relative to the point of winding on the bobbin. As a result, a constant load angle is maintained throughout the winding process. A wire diameter sensor also generates signals to the control system. The control system is responsive to the wire diameter signal for determining the number of windings which can be made on each layer of the bobbin. In an alternate embodiment, the control system determines the position of a movable flange in accordance with the diameter of the wire and the desired coil size to provide a predetermined number of windings per layer.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
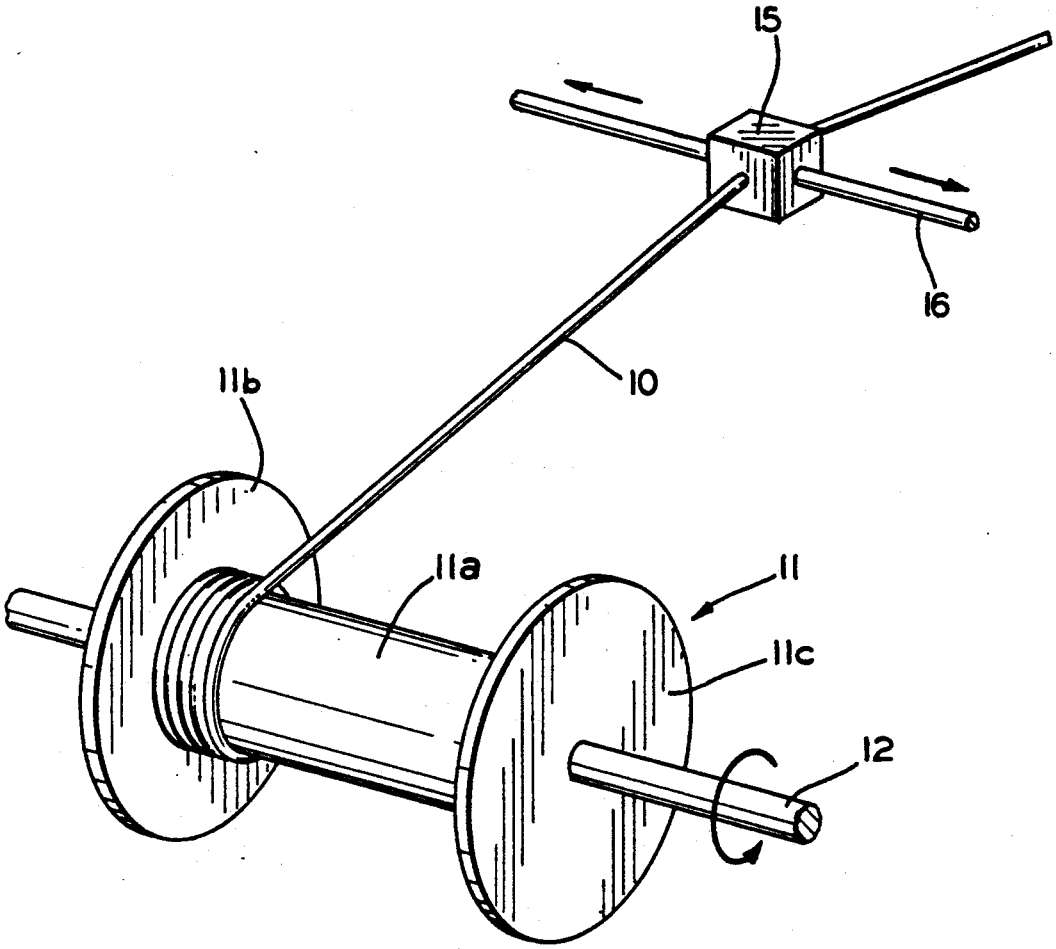
FIG. 1 ( PRIOR ART )
FIG. 1 is a perspective view showing a portion of a conventional machine for winding a wire onto a bobbin.
Figure 2A:
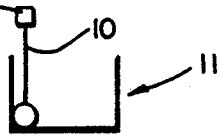
FIG. 2A (PRIOR ART)
FIGS. 2A through 2K are schematic side elevational views sequentially illustrating a bobbin being wound with a wire having a nominal diameter on a conventional coil winding apparatus.
Figure 2B:
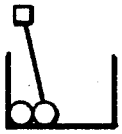
FIG. 2B (PRIOR ART)
Figure 2C:
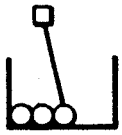
FIG. 2C (PRIOR ART)
Figure 2D:
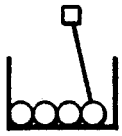
FIG. 2D (PRIOR ART)
Figure 2E:
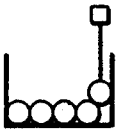
FIG. 2E (PRIOR ART)
Figure 2F:
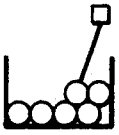
FIG. 2F (PRIOR ART)
Figure 2G:
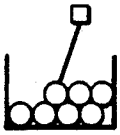
FIG. 2G (PRIOR ART)
Figure 2H:
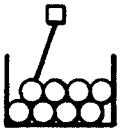
FIG. 2H (PRIOR ART)
Figure 2I:
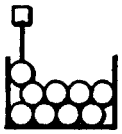
FIG. 2I (PRIOR ART)
Figure 2J:
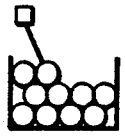
FIG. 2J (PRIOR ART)
Figure 2K:
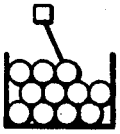
FIG. 2K (PRIOR ART)

Referring now to the drawings, there is illustrated in FIG. 1 a perspective view of a portion of a conventional machine for winding a wire 10 onto a bobbin, indicated generally at 11. The bobbin 11 includes a cylindrical spool portion 11*a* having a pair of circular flange portions 11*b* and 11*c* secured to the ends thereof. The bobbin 11 is mounted on a spindle 12 which is rotated by the coil winding machine in the direction noted by the arrow. Thus, as the bobbin 11 is wound, the wire 10 is wrapped about the spool portion 11*a* thereof. Preferably, the end of the wire 10 is secured to the spool portion 11*a* adjacent to the flange portion 11*b* such that the windings thereof are made in adjacent fashion axially approaching the other flange portion 11*c*.

When a complete layer of wire windings has been laid across the spool portion 11*a* from the one flange portion 11*b* to the other flange portion 11*c*, then a second layer of windings will be laid upon the first layer. The second layer of windings will be laid from the flange portion 11*c* to the flange portion 11*b*. A wire feeding mechanism 15 is provided for directing the wire 10 onto the bobbin 11 as it is rotated. The wire feeding mechanism 15 is mounted on a spindle 16 supported by the coil winding machine for axial movement. The means for controlling the axial movement of the wire feeding mechanism 15, which forms the basis of this invention, will be explained in detail below.

Referring now to FIGS. 2A through 2K, the sequence of events surrounding the normal winding of the bobbin 11 on a conventional machine is schematically illustrated. In this sequence, it is assumed that the diameter of the wire 10 being wound upon the bobbin 11 is constant and equal to a predetermined nominal diameter. For the purpose of simplifying the explanation of this sequence, the nominal diameter of the wire 10 is equal to one quarter of the axial length between the flange portions 11*b* and 11*c* of the bobbin 11 (in practice, however, the diameter of the wire 10 is typically much smaller). Given this nominal diameter, it can be easily calculated that the wire feeding mechanism 15 should be moved at an axial speed equal to one quarter of the axial length between the flanges 11*b* and 11*c* for each revolution of the bobbin 11. Thus, four windings of the wire 10 are provided for each layer on the bobbin 11. As shown in FIGS. 2A through 2K, the axial position of the wire feeding mechanism 15 always lags behind the axial position of the wire 10 as it is wound upon the bobbin 11. Therefore, the wire 10 is wound upon the bobbin 11 in an efficient manner.

Figure 3A:
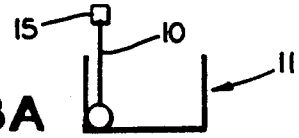
FIG. 3A (PRIOR ART)
FIGS. 3A through 3K are similar to FIGS. 2A through 2K showing a bobbin being wound with a wire having a diameter which is smaller than the nominal diameter, thus resulting in a coil breakup.
Figure 3B:
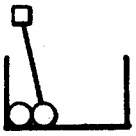
FIG. 3B (PRIOR ART)
Figure 3C:
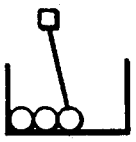
FIG. 3C (PRIOR ART)
Figure 3D:
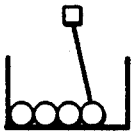
FIG. 3D (PRIOR ART)
Figure 3E:
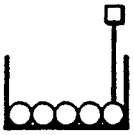
FIG. 3E (PRIOR ART)
Figure 3F:
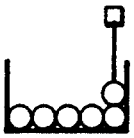
FIG. 3F (PRIOR ART)
Figure 3G:
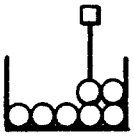
FIG. 3G (PRIOR ART)
Figure 3H:
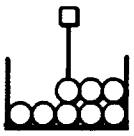
FIG. 3H (PRIOR ART)
Figure 3I:
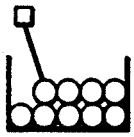
FIG. 3I (PRIOR ART)
Figure 3J:
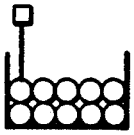
FIG. 3J (PRIOR ART)
Figure 3K:
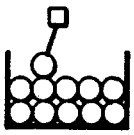
FIG. 3K (PRIOR ART)

However, as shown in FIGS. 3A through 3K, a breakup in the coil winding process can occur if the diameter of the wire 10 is smaller than the nominal diameter. If the actual diameter of the wire 10 is sufficiently small, then five windings will be provided for each layer on the bobbin 11, instead of the desired four windings. When this occurs, the axial position of the wire feeding mechanism will not always lag behind the axial position of the wire 10 as it wound upon the bobbin 11, as shown in FIGS. 3E through 3H. Worse yet, the axial position of the wire feeding mechanism may eventually lead ahead of the axial position of the wire 10, as shown in FIGS. 3I and 3K. When this occurs, gaps will be created between adjacent windings of the wire as shown in FIG. 3K, thus resulting in an inefficiently wound coil.

Figure 4:
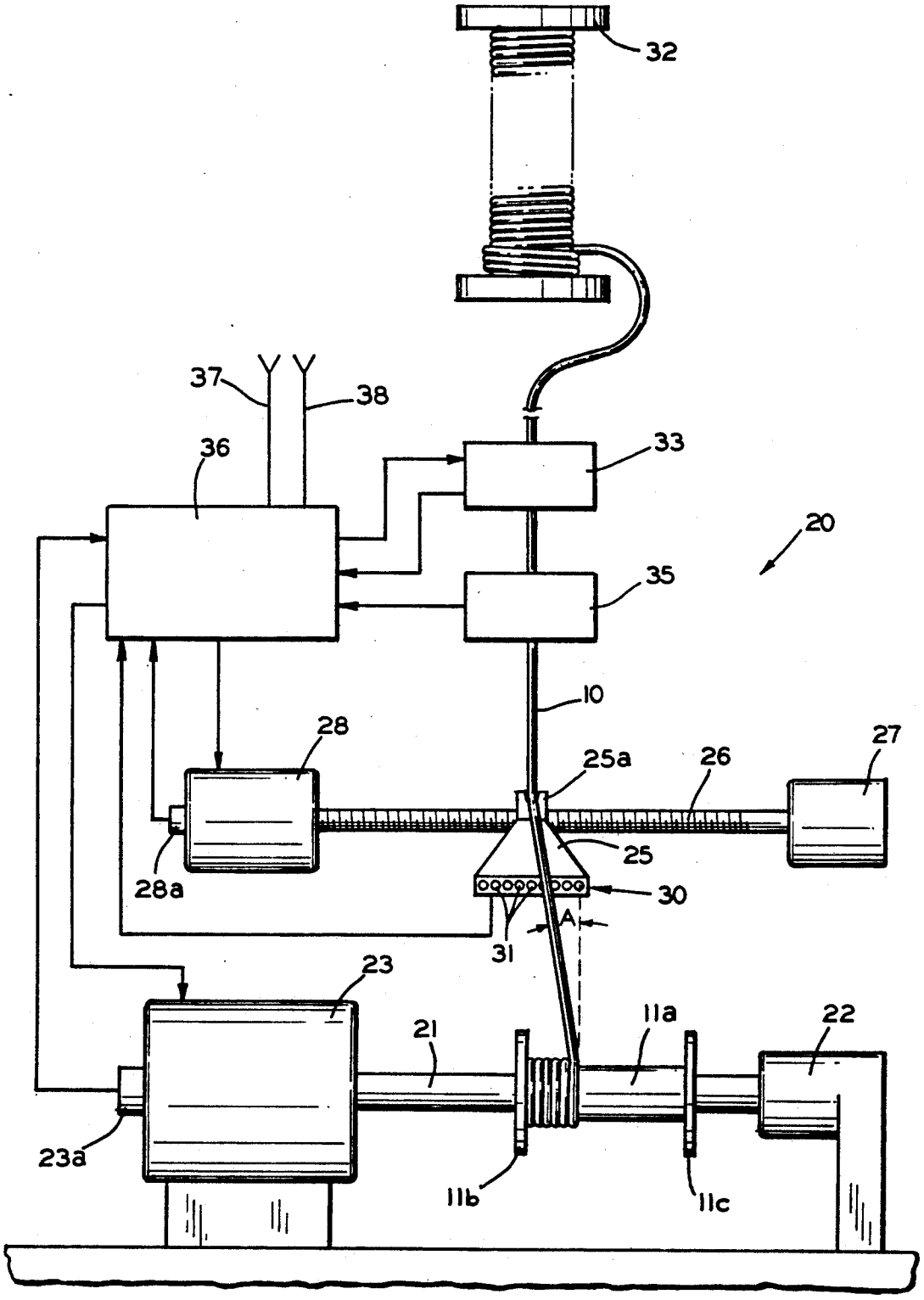
FIG. 4 is a diagrammatic view of a first embodiment of an improved coil winding apparatus in accordance with this invention.

To prevent this coil breakup sequence from occurring, an improved coil winding apparatus, indicated generally at 20 in FIG. 4, is provided. The coil winding apparatus 20 includes a shaft 21 upon which the bobbin 11 to be wound is mounted for rotation. One end of the shaft 21 is rotatably supported in a support bearing 22 fixed to the apparatus 20, while the other end of the shaft 21 is connected to a motor 23. The motor 23 is preferably a servo motor adapted to rotate the shaft 21 (and the bobbin 11 mounted thereon) at a predetermined speed. The servo motor 23 may include a shaft encoder 23*a*. The shaft encoder 23*a* is conventional in the art and is adapted to generate an electrical signal which is representative of the rotational position of the shaft 21.

A wire feeding mechanism 25 is provided for guiding the wire 10 as it is wound upon the bobbin 11. The wire feeding mechanism 25 is mounted on a ball screw shaft 26 by a conventional nut 25*a*. One end of the ball screw shaft 26 is rotatably supported in a support bearing 27 fixed to the apparatus 20, while the other end of the ball screw shaft 26 is connected to a motor 28. The motor 28 is preferably a bi-directional stepper or servo motor. When the stepper motor 28 is activated, the ball screw shaft 26 is rotated in either of two rotational directions. In response thereto, the wire feeding mechanism 25 is moved axially by a corresponding amount. Because of the inherent accuracy of the ball screw shaft 26 and the stepper motor 28, the wire feeding mechanism 25 can be precisely positioned axially relative to the bobbin 11. The stepper motor 28 may include a shaft encoder 28*a*. The shaft encoder 28*a* is conventional in the art and is adapted to generate an electrical signal which is representative of the rotational position of the ball screw shaft 26.

A wire feed angle sensor, indicated generally at 30, is mounted on the wire feeding mechanism 25. The wire feed angle sensor 30 is adapted to generate an electrical signal which is representative of the load angle (indicated at A in FIG. 4) at which the wire 10 is fed from the wire feeding mechanism 25 onto the bobbin 11. As discussed above, it is important that this load angle A be closely maintained during the coil winding process. In the illustrated embodiment, the wire feed angle sensor 30 is formed from a linear array of photoelectric cells 31 secured to the wire feeding mechanism 25. The photoelectric cells 31 are conventional in the art and are responsive to ambient light conditions. The position of the wire 10 relative to the photoelectric cells 31 can be determined by which of such cells 31 are blocked from the ambient light by the wire 10 passing thereover. Alternatively, a laser scanner (not shown) or similar non-contact sensor may be used to generate the load angle signal.

The wire 10 is supplied to the wire feeding mechanism 25 from a supply spool 32 through a tensioning mechanism 33 and a wire diameter sensor 35. The tensioning mechanism 33 is conventional in the art and is adapted to maintain a predetermined tension on the wire 10 as it is wound upon the bobbin 11. This insures that the wire 10 is not stretched because of excessive tension or wrapped too loosely because of insufficient tension. The tensioning mechanism 33 may be embodied as an adjustable clutch or brake (not shown) through which the wire 10 is passes. The clutch or brake can be controlled, in a manner described below, so as to adjust the tension on the wire 10. The tensioning mechanism 33 may be provided with a sensor (not shown) for generating an electrical signal which is representative of the tension of the wire 10. The wire diameter sensor 35 is also conventional in the art and is adapted to generate an electrical signal which is representative of the diameter of the wire 10 which is being wound upon the bobbin 11. The wire diameter sensor 35 may be embodied as any conventional contact or non-contact micrometer.

The apparatus 20 further includes a control system 36 for controlling the various components discussed above. The control system 36 may be embodied as a microprocessor or a programmable controller, both of which are adapted to receive the above-discussed electrical signals and, in response thereto, control the operation of the components of the coil winding apparatus 20 to effect the proper winding of the wire 10 upon the bobbin 11. Thus, the control system 36 receives the electrical signals from the tensioning mechanism 33, the wire diameter sensor 35, the shaft encoder 28*a* of the stepper motor 28, the wire feed angle sensor 30, and the shaft encoder 23*a* of the servo motor 23. In a manner which will be described below, the control system 36 is responsive to these signals for controlling the operation of the tensioning mechanism 33, the stepper motor 28, and the servo motor 23 so as to cause the wire 10 to be wound upon the bobbin 11.

In operation, the leading end of the wire 10 is initially secured to the spool portion 11*a* of the bobbin 11 adjacent one of the flange portions 11*b* thereof. Also, the control system 36 is initially programmed with certain information regarding the bobbin 11 to be wound. For example, the control system 36 can be programmed with the axial width of the spool portion 11*a* of the bobbin 11 and the total number of windings to be applied thereto. The control system 36 initially activates the stepper motor 28 to rotate the ball screw shaft 26, thereby moving the wire feeding mechanism 25 to a position relative to the bobbin 11 such that the wire 10 is disposed at a desired load angle A. It has been found desirable to maintain the load angle A between 0° and 5° when winding the wire 10 upon the bobbin 11, although this may vary depending upon the size of the wire 10 and other conditions.

Once the coil winding apparatus 20 has been set up in this manner, the control system 36 is activated to begin the winding process. To accomplish this, the servo motor 23 is activated to begin rotation of the shaft 21 and the bobbin 11 mounted thereon. As the bobbin 11 is rotated, the wire 10 is wound thereabout. The control system 36 monitors the load angle A (generated by the wire feed angle sensor 30) to constantly position the wire feeding mechanism 25 relative to the point of winding on the bobbin 11 such that the desired load angle A is always maintained Such positioning of the wire feeding mechanism 25 is accomplished by generating signals to the stepper motor 28 to control the operation thereof.

By monitoring the wire diameter signal generated by sensor 35 as the wire 10 is being wound upon the bobbin 11, the control system 36 can determine when a first layer of windings has been wound upon the spool portion 11*a*. This can be accomplished by dividing the axial length of the spool portion 11*a* of the bobbin 11 (which was initially programmed in the control system 36) by the diameter of the wire 10 being wound upon the bobbin 11. Since the diameter of the wire 10 does not usually change significantly from the beginning to the end of the winding of a single bobbin 11, the control system 36 may simply sample the wire diameter signal from the sensor 35 only at the beginning of the winding process and make its calculation based thereupon. Alternatively, the control system 36 may constantly monitor the wire diameter signal, summing the diameters of each of the windings upon the bobbin 11 together to determine the precise position of the point at which the wire 10 is wound upon the bobbin 11.

In either event, the control system 36 uses this information to determine when the first layer of windings has been completed. At that point, the control system 36 activates the stepper motor 28 to move past the point of winding so as to begin a second layer of windings upon the bobbin 11. As discussed above, the second layer of windings is laid upon the bobbin 11 in the opposite axial direction from the first layer of windings. Thus, the wire feeding mechanism 25 is controlled so as to maintain the lagging relationship in this opposite axial direction. This process is repeated so as to wind successive layers of wire upon the bobbin 11 in alternating axial directions. When the pre-programmed total number of such windings have been made, the control system 36 de-activates the servo motor 23 to conclude the winding process.

Throughout this entire process, the control system 36 monitors the tension on the wire by means of the tensioning mechanism 33. The control system 36 is responsive to the wire tension signal for controlling the operation of the tensioning mechanism 33 to maintain a desired tension on the wire 10 as it is wound upon the bobbin 11. As mentioned above, such constant wire tension is important in precisely winding the wire 10 on the bobbin 11.

Figure 5:
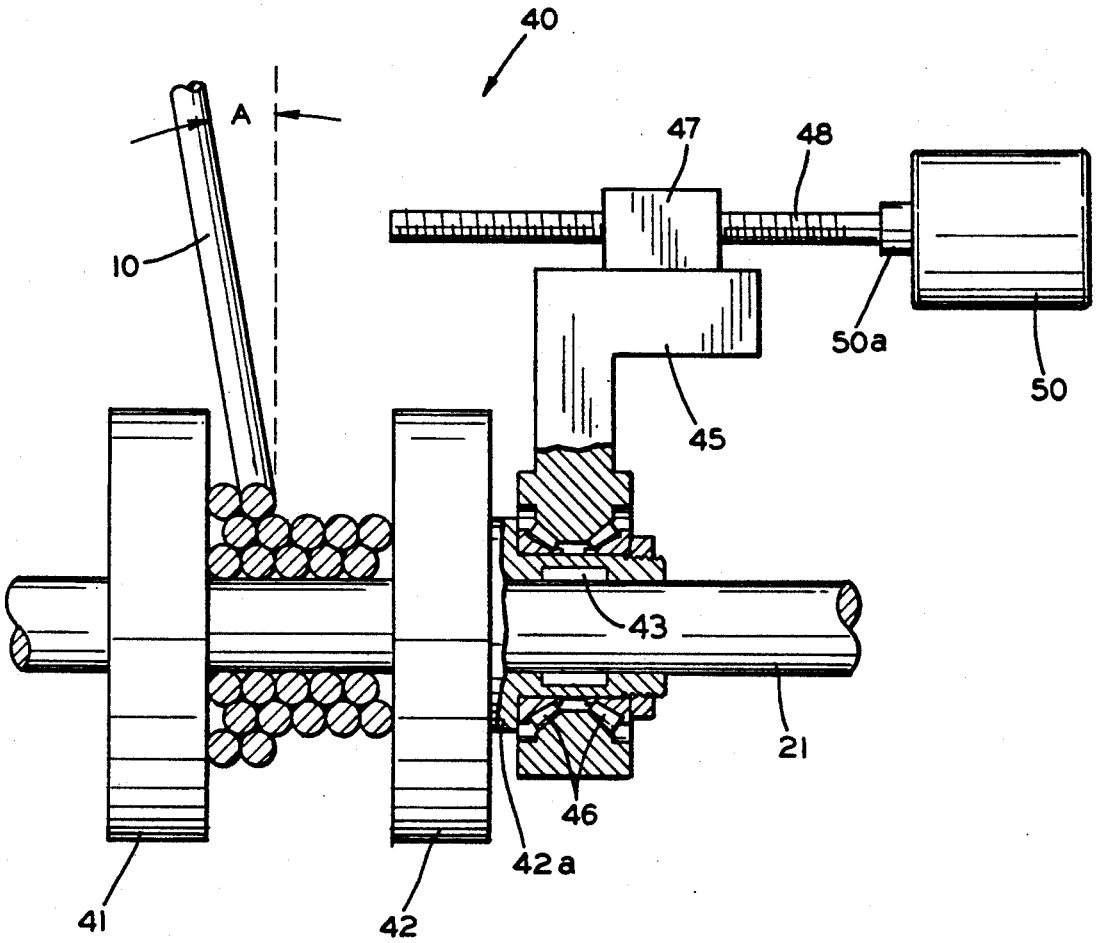
FIG. 5 is a diagrammatic view of a portion of a second embodiment of an improved coil winding apparatus in accordance with this invention.

Referring now to FIG. 5, there is illustrated a portion of an alternate embodiment of a coil winding apparatus, indicated generally at 40, in accordance with this invention. The overall apparatus 40 is similar to the apparatus 20 described above, except that the wire 10 is wound directly upon the shaft 21 to form a free standing coil, instead of being wound upon the bobbin 11. To define the axial length of the coil to be wound, first and second flanges 41 and 42, respectively, are provided. The first flange 41 is secured to the shaft 21 for rotation therewith. The second flange 42 includes a cylindrical hub portion 42*a* which is journalled on the shaft 21 by means of a sprag clutch 43. The sprag clutch 43 is conventional in the art and is adapted to provide a one-way driving connection between the shaft 21 and the second flange 42. Thus, when the shaft 21 is rotated in a first direction (the winding direction) by the servo motor 23, the second flange 42 rotatably driven therewith. However, when the shaft 21 is rotated in the opposite direction, the driving connection between the shaft 21 and the second flange is discontinued to permit relative axial movement.

Axial movement of the second flange 42 is accomplished by means of a control arm 45. One end of the control arm 45 is connected to the hub portion 42*a* of the second flange 42 through a pair of tapered roller bearings 46. Thus, axial movement of the control arm 45 causes axial movement of the second flange 42, without interfering with the rotational movement of the second flange 42 during the winding process. The other end of the control arm 45 is connected to a nut 47 mounted on a ball screw shaft 48. A bi-directional electric motor 50 is connected to rotate the ball screw shaft 48 and, therefore, cause corresponding axial movement of the nut 47, the control arm 45, and the second flange 42. The operation of the motor 50 is controlled by the control system 36. The motor 50 may include a shaft encoder 50*a*. The shaft encoder 50*a* is conventional in the art and is adapted to generate an electrical signal to the control system 36 which is representative of the rotational position of the shaft 21.

In operation, the leading end of the wire 10 is initially secured to the shaft 21, typically adjacent the first flange 41. Also, the control system 36 is initially programmed with certain information regarding the coil to be wound, specifically, the desired axial length thereof and the total number of windings to be made by means of respective input lines 37 and 38. Based upon this information and upon the wire diameter information supplied by the wire diameter sensor 35, the control system 36 can activate the motor 50 to move the second flange 42 to a desired position relative to the first flange 41. Thus, the axial length of the coil to be wound is automatically determined. The subsequent operation of the winding apparatus 40 is the same as described above.

After the coil has been wound upon the shaft 21, a conventional heat setting operation is typically performed on the wound coil so that it will retain its hollow cylindrical shape when removed from the shaft 21. It has been found desirable to apply a slight force to axially compress the coil during this heat setting operation. To accomplish this, the control system 36 can be programmed to automatically activate the motor 50 to cause the second flange 42 to compress the wound coil on the shaft 21. When the heat setting process is completed, the control system 36 activates the motor 50 to move the second flange 42 out of engagement with the coil to permit the removal thereof.

Alternatively, the apparatus 40 may be used to wind a coil upon a bobbin. The bobbin would be mounted on the shaft 21 for rotation therewith. The second flange 42 would be moved into engagement with the end flange of the bobbin to retain the bobbin on the shaft 21. The winding of the coil upon the bobbin would be performed according to the same process as described above.

In accordance with the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. An apparatus for winding a filament into a free standing coil having an approximate desired axial length comprising:

a shaft adapted to have one end of the filament secured thereto;

first and second flanges mounted about said shaft, said second flange being axially movable relative to said shaft and said first flange;

means for rotating said shaft so as to wind the filament thereabout;

means for guiding the filament between said first and second flanges as it si wound about said shaft;

means for generating a signal which is representative of the diameter of the filament as it wound about said shaft;

means for generating a signal which is representative of a desired axial length for the coil;

control means responsive to said filament diameter signal and said desired axial length signal for generating a signal which is representative of an approximate desired axial length for the coil which is dependent upon variations in the diameter of the filament as it is wound upon said shaft; and means responsive to said control means signal for moving said second flange axially along said shaft so that it is separated from said first flange by the approximate desired axial length.

2. The apparatus for winding defined in claim 1 further including means for permitting relative rotation between said second flange and said means for moving said second flange.

3. The apparatus for winding defined in claim 2 wherein said means for permitting relative rotation includes a bearing provided between said second flange and a portion of said means for moving.

4. The apparatus for winding defined in claim 1 further including means for causing said second flange to rotate with said shaft.

5. The apparatus for winding defined in claim 4 wherein said means for causing includes an overrunning clutch provided between said second flange and said shaft.

6. The apparatus for winding defined in claim 1 further including means for generating a signal which is representative of the load angle of the filament as it extends from said means for guiding to the point of winding on the shaft, said control means also being responsive to said load angle signal for controlling the operation of said means for guiding the filament as it is wound about the shaft.

7. The apparatus for winding defined in claim 1 wherein said means for guiding includes a filament feeding mechanism for engaging and guiding the filament as it is wound about said shaft and means for moving said filament feeding mechanism relative to said shaft such that the filament is wound about said shaft in a predetermined manner.

8. The apparatus for winding defined in claim 7 wherein said means for moving includes a nut connected to said filament feeding mechanism, a ball screw shaft upon which said nut is mounted, and means for rotating said ball screw shaft to effect linear movement of said nut and said filament feeding mechanism.

9. The apparatus for winding defined in claim 1 wherein said control means controls said means for moving so as to maintain said filament feeding mechanism at a predetermined axial distance behind the point of winding of the filament on said shaft so as to maintain the filament at a predetermined load angle therebetween.

10. The apparatus for winding defined in claim 1 further including means for maintaining a predetermined amount of tension on the filament as it is wound upon said shaft.

11. The apparatus for winding defined in claim 10 wherein said means for maintaining a predetermined amount of tension on the filament includes means for generating a signal which is representative of the amount of tension on the filament and means for increasing and decreasing the amount of tension on the filament, said control means being responsive to said filament tension signal for controlling the operation of said means for increasing and decreasing the amount of tension on the filament.

* * * * *